US009341370B2

(12) United States Patent
Min

(10) Patent No.: US 9,341,370 B2
(45) Date of Patent: May 17, 2016

(54) GAS BOILER INCLUDING OUTPUT ADJUSTING DEVICE, AND METHOD OF ADJUSTING OUTPUT OF GAS BOILER

(75) Inventor: Tae-Sik Min, Seoul (KR)

(73) Assignee: KYUNDONG NAVIEN CO., LTD., Seoul (KR)

( * ) Notice: Subject to any disclaimer, the term of this patent is extended or adjusted under 35 U.S.C. 154(b) by 428 days.

(21) Appl. No.: 13/994,240

(22) PCT Filed: Aug. 19, 2011

(86) PCT No.: PCT/KR2011/006119

§ 371 (c)(1),
(2), (4) Date: Jun. 14, 2013

(87) PCT Pub. No.: WO2012/081796

PCT Pub. Date: Jun. 21, 2012

(65) Prior Publication Data

US 2013/0260325 A1 Oct. 3, 2013

(30) Foreign Application Priority Data

Dec. 15, 2010 (KR) ..... 10-2010-0128049

(51) Int. Cl.

| | |
|---|---|
| ***F23N 1/02*** | (2006.01) |
| ***F23D 14/02*** | (2006.01) |
| ***F23D 14/36*** | (2006.01) |
| ***F23L 5/02*** | (2006.01) |
| ***F23L 13/00*** | (2006.01) |

(52) U.S. Cl.

CPC *F23N 1/02* (2013.01); *F23D 14/02* (2013.01); *F23D 14/36* (2013.01); *F23L 5/02* (2013.01); *F23L 13/00* (2013.01); *F23N 2033/08* (2013.01)

(58) Field of Classification Search

CPC ..... F23N 1/02; F23N 2033/08; F23L 5/02; F23L 13/00; F23D 14/02; F23D 14/36

See application file for complete search history.

(56) References Cited

U.S. PATENT DOCUMENTS

| | | | | |
|---|---|---|---|---|
| 5,971,026 | A | 10/1999 | Beran | |
| 6,840,198 | B2 * | 1/2005 | Kang | F23N 1/022 122/14.1 |

FOREIGN PATENT DOCUMENTS

| | | | |
|---|---|---|---|
| JP | 2002-162028 | A | 6/2002 |
| KR | 10-2006-0017069 | A | 2/2006 |
| KR | 10-2006-0017071 | A | 2/2006 |

OTHER PUBLICATIONS

Korean Intellectual Property Office, International Search Report in International Patent Application No. PCT/KR2011/006119 (Mar. 2, 2012).

*Primary Examiner* — Alfred Basichas
(74) *Attorney, Agent, or Firm* — Leydig, Voit & Mayer, Ltd.

(57) ABSTRACT

A gas boiler and a method of adjusting output of the gas boiler by adjusting mixture ratio of air and gas for combustion in proportion to an output value of the boiler, and continuously changing the mixture regardless of the boiler output. The gas boiler includes a ventilator, a gas valve, a burner, a combustion chamber, a heat exchanger, and an exhaust gas hood. The inlet of the ventilator includes an output adjusting device having an air inlet; an air adjustment valve; a gas outlet; a gas adjustment valve that adjusts the gas passing through the gas outlet; and a valve driving unit that drives the air adjustment valve and the gas adjustment valve. Output of the burner is continuously adjusted by adjusting distance between the air adjustment valve and the gas adjustment valve, and distance between the air inlet and the gas outlet.

7 Claims, 4 Drawing Sheets

GAS BOILER INCLUDING OUTPUT ADJUSTING DEVICE, AND METHOD OF ADJUSTING OUTPUT OF GAS BOILER

TECHNICAL FIELD

The present invention relates to a gas boiler including an output adjusting device, and method of adjusting output of gas boiler, and more particularly, to a gas boiler including an output adjusting device, and method of adjusting output of gas boiler which may simplify a structure of the output adjusting device for uniformly adjusting a mixture ratio of air and gas for combustion in proportion to an output value of the boiler, and may accurately adjust an output of the boiler even when a set output value of the boiler is in a low output range.

BACKGROUND ART

A conventional gas boiler includes a ventilator 10 that introduces external air and supplies air necessary for combustion, a gas valve 20 that adjusts supply of gas for combustion that is mixed with the air introduced by the ventilator 10, a burner 30 that combusts a mixture of the gas for combustion and the air supplied by the ventilator 10, a combustion chamber 40 in which the combustion of the burner 30 occurs, a heat exchanger 50 in which a heat exchange between combustion gas generated by the burner 30 and hot water occurs, and an exhaust gas hood 60 through which the combustion gas passing through the heat exchanger 50 is discharged.

In the conventional gas boiler constructed as described above, when an output of a boiler is changed, it means that an output of the burner 30 is changed. In order to change the output of the burner 30, the amount of air and the amount of gas have to be changed in proportion to the output.

However, the conventional gas boiler has problems in that since the ventilator 10 that introduces external air and the gas valve 20 that adjusts the amount of gas for combustion which is supplied are separately disposed and an additional unit for controlling the amount of gas supplied by the gas valve 20 in proportion to the amount of air supplied by the ventilator 10 has to be provided, a structure of a device is complex and it is difficult to accurately control a mixture ratio of the air and the gas for combustion according to a preset output of the boiler.

A method of changing the amount of air which is a method of changing the number of rotations of the ventilator 10 involves rotating the ventilator 10 at a high speed when a high output of the boiler is necessary and rotating the ventilator 10 at a low speed when a low output of the boiler is necessary.

In this case, as the ventilator 10 is changed from a high speed rotation to a low speed rotation and the number of rotations is reduced, a wind pressure of air supplied by the ventilator 10 is also reduced.

In this case, when the wind pressure is reduced to a value less than or equal to a predetermined value, although the ventilator 10 rotates at a low speed, the ventilator 10 does not supply air.

Accordingly, there is a limitation in reducing an output of the boiler using only a method of reducing the number of rotations of the ventilator 10, reducing the amount of air which is supplied, and proportionately reducing the amount of gas for combustion supplied by the gas valve 20 in the conventional gas boiler. Accordingly, a range of a turn-down ratio (TDR) of the boiler may not be increased.

The TDR refers to a 'ratio of a maximum amount of gas consumption to a minimum amount of gas consumption' in a gas combustion device in which the amount of gas is variably adjusted. The TDR is limited by the minimum amount of gas consumption for maintaining a stable flame. In a gas boiler, as the TDR increases, user convenience during heating and hot water supply may increase, a deviation in temperature control may decrease, and the durability of a device may be improved.

DISCLOSURE

Technical Problem

The present invention is directed to providing a gas boiler including an output adjusting device which may simplify a structure of the output adjusting device for uniformly adjusting a mixture ratio of air and gas for combustion in proportion to an output value of the boiler.

The present invention is also directed to providing a gas boiler including an output adjusting device, and method of adjusting output of gas boiler which may increase a turn-down ratio (TDR) by accurately controlling an output of the boiler by continuously changing the amount of a mixture of air and gas for combustion which are supplied even when the output of the boiler is a low output as well as a high output.

Technical Solution

One aspect of the present invention provides a gas boiler including: a ventilator that introduces external air and supplies air necessary for combustion; a gas valve that adjusts supply of gas for combustion that is mixed with the air; a burner that combusts a mixture of the gas and the air supplied by the ventilator; a combustion chamber in which the combustion of the burner occurs; a heat exchanger that absorbs combustion heat of combustion gas generated by the burner; and an exhaust gas hood through which the combustion gas passing through the heat exchanger is discharged, the gas for combustion passing through the gas valve being supplied to an inlet of the ventilator, wherein the inlet of the ventilator is provided with an output adjusting device including: an air inlet through which the external air is supplied to the ventilator; an air adjustment valve that adjusts an amount of the air supplied through the air inlet; a gas outlet through which the gas passing through the gas valve is discharged; a gas adjustment valve that adjusts an amount of the gas for combustion passing through the gas outlet; and a valve driving unit that drives the air adjustment valve and the gas adjustment valve, wherein the air adjustment valve and the gas adjustment valve are integrally formed with each other, and an output of the burner is continuously adjusted by adjusting a distance between the air adjustment valve and the gas adjustment valve and between the air inlet and the gas outlet.

A distance between the air adjustment valve and the air inlet and a distance between the gas adjustment valve and the gas outlet may be changed equally.

The air adjustment valve and the gas adjustment valve may be integrally operated by the same valve driving unit, to continuously adjust amounts of the air and the gas for combustion which are supplied.

The air adjustment valve and the gas adjustment valve may be coupled in concentric circular shapes to a valve movable shaft, and the air inlet and the gas outlet may be provided in concentric cylindrical shapes to be opened and closed during reciprocations of the air adjustment valve and the gas adjustment valve.

The gas valve and the gas outlet may be provided on an axis of the valve movable shaft, and the air adjustment valve and the air inlet may be provided around outer surfaces of the gas valve and the gas outlet.

A position where the gas valve contacts the gas outlet may be lower in terms of height than a position where the air adjustment valve contacts the air inlet, so that the gas for combustion discharged to the gas outlet is mixed with the supplied air in a mixing chamber in the ventilator without leaking to the air inlet.

Another aspect of the present invention provides a method of adjusting of gas boiler including: setting an output value of a boiler; comparing the set output value with a limit output value; and when the set output value is greater than or equal to the limit output value, changing an output of the boiler by changing a number of rotations of a ventilator, and when the set output value is less than the limit output value, adjusting a flow rate of a fluid in an output adjusting device in response to the set output value.

The adjusting a flow rate of a fluid in an output adjusting device may include adjusting the flow rate of a fluid in a state where the number of rotations of the ventilator corresponding to the limit output value is maintained.

Advantageous Effects

According to gas boiler including output adjusting device, and method adjusting output of gas boiler of the present invention, since an air adjustment valve and a gas adjustment valve are integrally provided at an inlet of a ventilator and degrees by which the air adjustment valve and the gas adjustment valve are opened are equally adjusted by the same valve driving unit, a structure of the output adjusting device may be simplified, and a mixture ratio of air and gas for combustion may be uniformly controlled in proportion to an output of a burner.

Also, according to the present invention, since an output may be accurately controlled by adjusting a flow rate in the output adjusting device even when a set output of a boiler is in a low output range, a turn-down ratio (TDR) may be increased, and the performance of the boiler may be improved.

DESCRIPTION OF DRAWINGS

FIGS. 4 and 5 are cut-away perspective views illustrating an output adjustment unit constituting the output adjusting device of FIG. 3, wherein FIG. 4 illustrates a closed state and FIG. 5 illustrates an open state.

MODES OF THE INVENTION

The present invention will now be described more fully with reference to the accompanying drawings, in which exemplary embodiments of the invention are shown.

Figure 1:
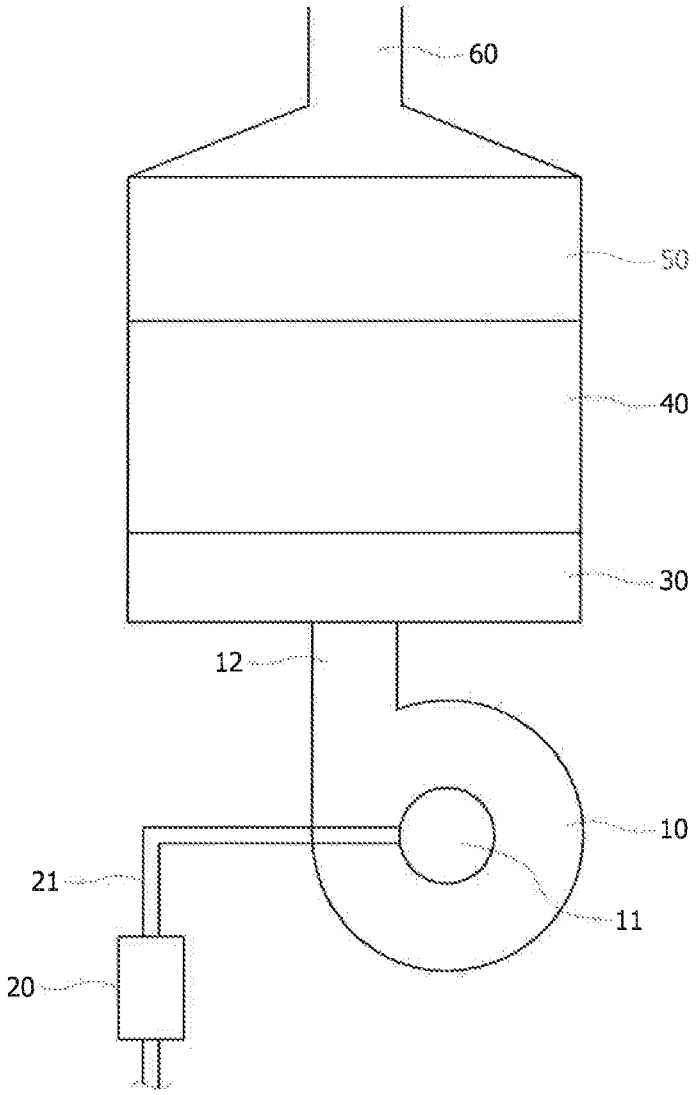
FIG. 1 is a cross-sectional view schematically illustrating a structure of a conventional gas boiler.
Figure 2:
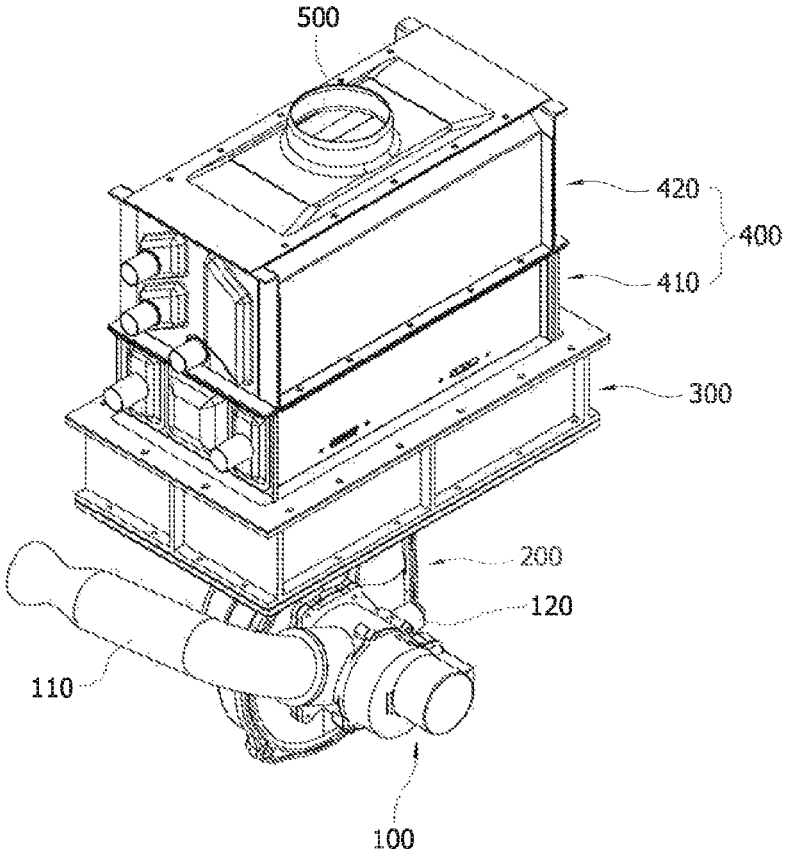
FIG. 2 is a perspective view illustrating an outer appearance of a gas boiler including an output adjusting device, according to an embodiment of the present invention.

FIG. 2 is a perspective view illustrating an outer appearance of a gas boiler including an output adjusting device, according to an embodiment of the present invention.

Referring to FIG. 2, the gas boiler includes an output adjusting device 100 that uniformly adjusts a mixture ratio of air and gas for combustion in proportion of a set output of a boiler, a ventilator 200 that is integrally connected to the output adjusting device 100 and supplies a mixture of the air and the gas for combustion to a burner (not shown), a combustion chamber 300 in which the burner is mounted and combustion occurs, a heat exchanger 400 including a sensible heat exchanger 410 that absorbs sensible heat of a combustion product generated in the combustion chamber 300 and a latent heat exchanger 420 that absorbs latent heat of vapor included in the combustion product on which a heat exchange has been performed by the sensible heat exchanger 410, and an exhaust gas hood 500 through which combustion gas passing through the heat exchanger 400 is discharged to the outside.

Figure 3:
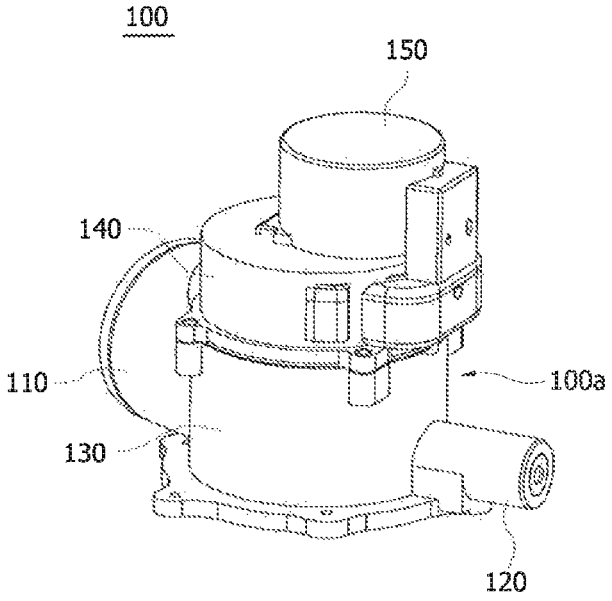
FIG. 3 is a perspective view illustrating the output adjusting device of FIG. 2.
Figure 4:
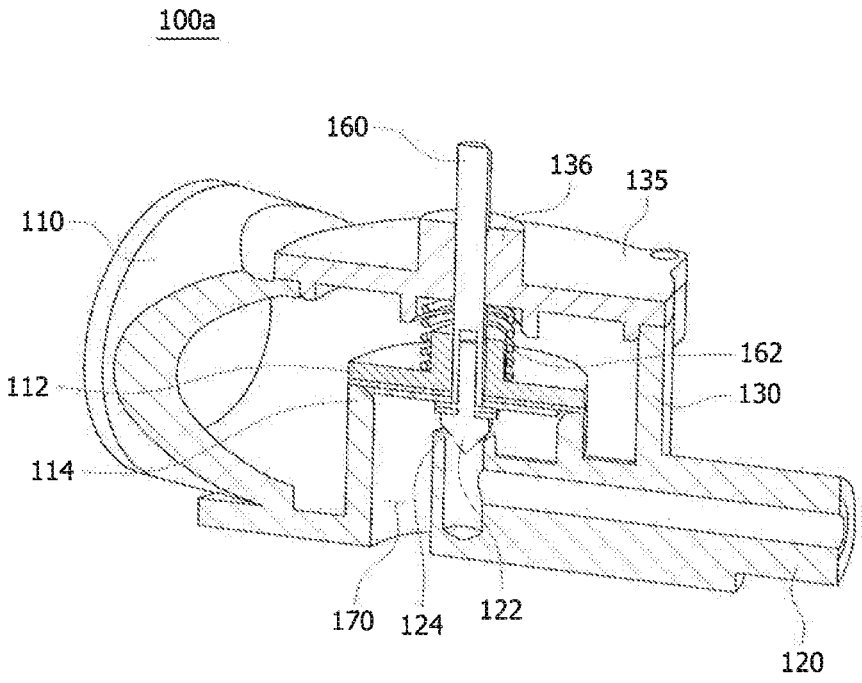
Figure 5:
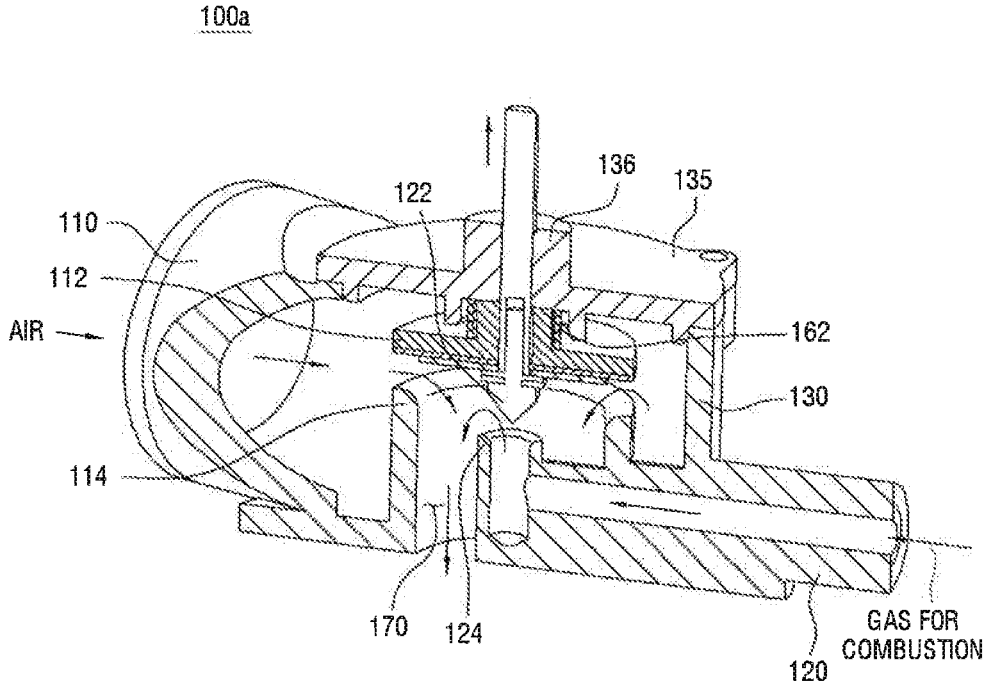

FIG. 3 is a perspective view illustrating the output adjusting device of FIG. 2. FIGS. 4 and 5 are cut-away perspective views illustrating an output adjustment unit constituting the output adjusting device of FIG. 3, wherein FIG. 4 illustrates a state where a valve is closed and FIG. 5 illustrates a state where the valve is opened.

The output adjusting device 100 for adjusting a flow rate of a mixture of the air and the gas for combustion in proportion to a set output value in a low output range where an output value of a boiler is less than a predetermined value includes a housing 130 on both sides of which an air inlet pipe 110 and a gas inlet pipe 120 are provided and in which the air and the gas for combustion are mixed, an upper cover 140 that is coupled to the housing 130, and a valve driving unit 150 that is provided on the upper cover 140 and supplies power for reciprocating an air adjustment valve 112 and a gas adjustment valve 122.

A gas valve (not shown) that cuts off supply of the gas for combustion is provided on the gas inlet pipe 120. When the gas valve is opened, the gas for combustion passing through the gas valve is supplied into an inlet of the ventilator 200 through the gas inlet pipe 120.

The valve driving unit 150 which is a common driving source for integrally driving the air adjustment valve 112 and the gas adjustment valve 122 according to a set output signal of the boiler may be a bidirectional motor.

An output adjustment unit 100*a* including the housing 130 and elements disposed in the housing 130, from among the elements of the output adjusting device 100, is coupled to the inlet of the ventilator 200 and adjusts the amounts of the external air and the gas for combustion which are supplied.

Description of Reference Numerals

| | | |
|---|---|---|
| 10: ventilator | 11: ventilator inlet | 12: ventilator outlet |
| 20: gas valve | 21. gas supply pipe | 30: burner |
| 40: combustion chamber | 50: heat exchanger | 60: exhaust gas hood |
| 100: output adjusting device | 100a: output adjustment unit | 110: air inlet pipe |
| 112: air adjustment valve | 114: air inlet | 120: gas inlet pipe |
| 122: gas adjustment valve | 124: gas outlet | 130: housing |
| 135: valve fixture | 136: guide unit140: upper cover | 150: valve drivingunit |
| 160: valve movable shaft | 162: spring | 170: mixing chamber |
| 200: ventilator | 300: combustion chamber | 400: heat exchanger |
| 410: sensible heat exchanger | 420: latent heat exchanger | 500: exhaust gas hood |

An outer appearance of the output adjustment unit 100*a* includes the housing 130 on both sides of which a gas inlet pipe 120 through which the gas for combustion is introduced and an air inlet pipe 110 through which the external air is introduced are provided, and a valve fixture 135 that is coupled to an upper portion of the housing 130 and on a central portion of which a guide unit 136 for guiding a vertical movement of a valve movable shaft 160 driven by the valve driving unit 150 is provided.

An air inlet 114 that is connected to the air inlet pipe 110 and acts as a path through which the introduced air is supplied to the inlet of the ventilator 200, and a gas outlet 124 that acts as a path through which the gas for combustion introduced through the gas inlet pipe 120 when the gas valve is opened is supplied to the inlet of the ventilator 200 are provided in the housing 130.

The air inlet 114 and the gas outlet 124 have cylindrical shapes whose tops are opened in directions of FIGS. 4 and 5. The air inlet 114 is provided around an outer surface of the gas outlet 124, and a mixing chamber 170 in which the air and the gas for combustion are mixed is provided in a space between the outer surface of the gas outlet 124 and an inner surface of the air inlet 114, to communicate with the inlet of the ventilator 200 disposed under the mixing chamber 170.

The gas adjustment valve 122 and the air adjustment valve 112 are disposed over the gas outlet 124 and the air inlet 114 and are integrally coupled in concentric circular shapes to the valve movable shaft 160. As the gas adjustment valve 122 and the air adjustment valve 112 vertically move in accordance with a vertical movement of the valve movable shaft 160 due to an operation of the valve driving unit 150, the gas outlet 124 and the air inlet 114 are opened and closed.

The gas adjustment valve 122 and the gas outlet 124 are provided on an axis of the valve movable shaft 160, and the air adjustment valve 112 and the air inlet 114 are provided around outer surfaces of the gas adjustment valve 122 and the gas outlet 124.

An upper end of the gas outlet 124 is formed to be lower than an upper end of the air inlet 114, and a lower end of the gas adjustment valve 122 is formed to be lower than a lower end of the air adjustment valve 112. Accordingly, when the gas adjustment valve 122 and the air adjustment valve 112 are opened to mix the air and the gas for combustion, the gas for combustion discharged to the gas outlet 124 may smoothly flow into the mixing chamber 170 without leaking to the air inlet 114.

A spring 162 is disposed between the air adjustment valve 112 and the valve fixture 135. Since the spring 162 applies an elastic force to press the air adjustment valve 112 and the gas adjustment valve 122 toward the air inlet 114 and the gas outlet 124, the flow of a fluid may be blocked in a state where the air adjustment valve 112 and the gas adjustment valve 122 are closed.

Referring to FIG. 5, when the valve movable shaft 160 is moved upward by the valve driving unit 150, the air adjustment valve 112 and the gas adjustment valve 122 integrally coupled to the valve movable shaft 160 are also moved upward. In this case, a distance L1 between the gas adjustment valve 122 and the gas outlet 124 and a distance L2 between the air adjustment valve 112 and the air inlet 114 are changed equally.

As such, since the air adjustment valve 112 and the gas adjustment valve 122 are integrally provided on the valve movable shaft 160, and the air adjustment valve 112 and the gas adjustment valve 122 are simultaneously reciprocated by the same valve driving unit 150 to adjust the amounts of the air and the gas for combustion which are supplied, a structure of the output adjusting device 100 may be simplified, and a mixture ratio of the air and the gas for combustion may be continuously uniformly adjusted in proportion to a set output of the boiler.

Figure 6:
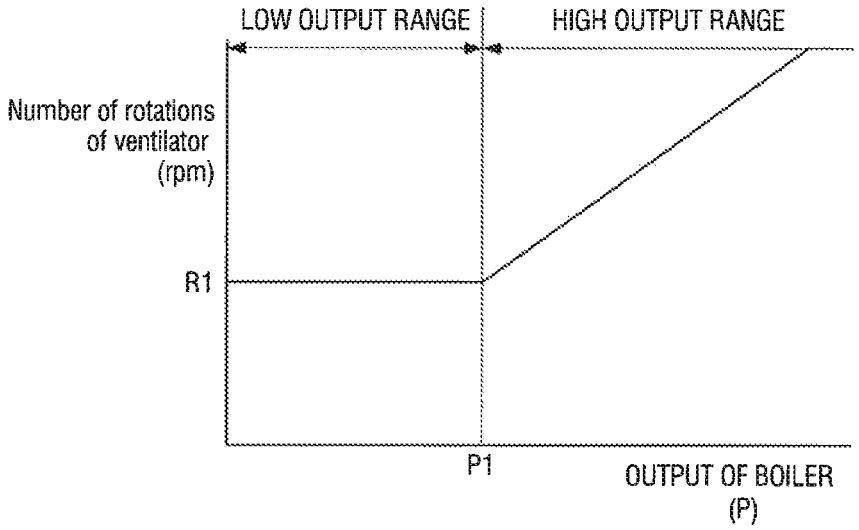
FIG. 6 is a graph illustrating a relationship between the number of rotations of a ventilator and an output of a boiler of the gas boiler, according to an embodiment of the present invention.

FIG. 6 is a graph illustrating a relationship between the number of rotations of the ventilator and an output of the boiler of the gas boiler, according to an embodiment of the present invention.

The gas boiler constructed as described above adjusts an output of the boiler by adjusting the amount of air which is supplied by changing the number of rotations of the ventilator 200 in proportion to a set output value in a high output range where an output value of the boiler which is set by a user is greater than or equal to a limit output value P1, and adjusts a flow rate of the air and the gas for combustion in the output adjusting device 100 in response to a set output value in a state where the number of rotations R1 of the ventilator 200 which corresponds to the limit output value P1 is maintained in a low output range where the output value of the boiler which is set by the user is less than the limit output value P1.

Here, the 'limit output value P1' refers to a boundary value between a high output and a low output. The limit output value P1 may be set to an output value (or more) corresponding to the number of rotations of the ventilator 200 at a time when, assuming that the number of rotations of the ventilator 200 is reduced from a high speed to a low speed and thus a wind pressure is reduced, the amount of air supplied by the ventilator 200 becomes zero.

As such, when a set output value of the boiler is in a high output range, the set output value may be responded by adjusting the number of rotations of the ventilator 200, and when the set output value is in a low output range, the set output value may be responded by adjusting a flow rate in the output adjusting device 100 in a state where the number of rotations of the ventilator 200 is maintained as the number of rotations R1. Accordingly, an output of the boiler may be continuously accurately controlled over entire ranges ranging from a high output range to a low output range, and thus a range of a turn-down ratio (TDR) may be increased.

As such, according to the present invention, a limitation in adjusting an output of the boiler due to a decrease in a wind pressure in a low output range when only a method of changing the number of rotations of the ventilator 200 is used in the low output range as well as a high output range may be solved.

Figure 7:
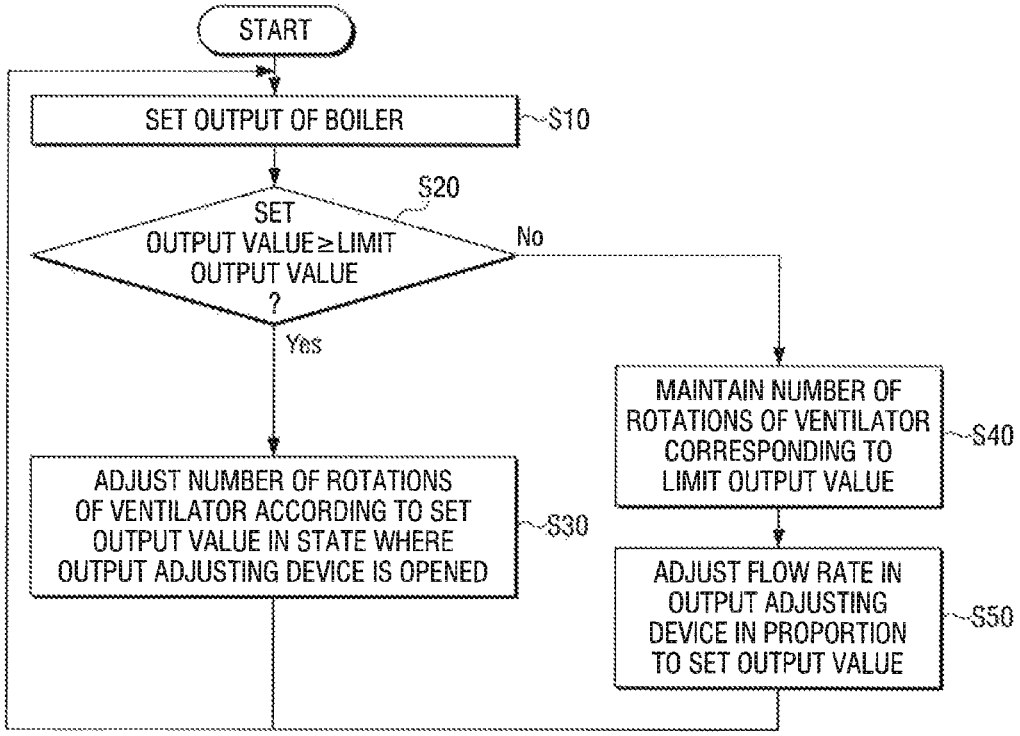
FIG. 7 is a flowchart illustrating a method of adjusting of gas, according to an embodiment of the present invention.

An output adjustment method of the boiler constructed as described above will be explained. FIG. 7 is a flowchart illustrating a method of adjusting of gas boiler, according to an embodiment of the present invention.

An output value of the boiler is set in accordance with a heating load or a hot water load to be set by the user (S10). A control unit (not shown) included in the boiler compares the set output value with a limit output value P1 (S20).

When it is determined that the set output value of the boiler is greater than or equal to the limit output value P1, the control unit determines that the set output value is in a high output range and adjusts an output of the boiler by adjusting the number of rotations of the ventilator 200 according to the set output value of the boiler in a state where the output adjusting device 100 is opened to mix air and gas for combustion at a predetermined mixture ratio and supply a mixture of the air and the gas for combustion (S30).

When it is determined that the output value of the boiler which is set by the user is less than the limit output value P1, the control unit determines that the set output value is in a low output range and controls to maintain the number of rotations R1 of the ventilator 200 which corresponds to the limit output value P1 (S40), and adjusts the amounts of the air and the gas for combustion which are supplied by controlling an operation of the valve driving unit 150 of the output adjusting device 100 in proportion to the set output value (S50).

As such, according to the method of adjusting output of gas boiler of the present invention, since a method of adjusting a flow rate of a mixture in the output adjusting device 100 is used in a state where the number of rotations of the ventilator is maintained, unlike a conventional method of changing the number of rotations of the ventilator when a set output value of the boiler is in a low output range, the set output value even in the low output range may be continuously accurately controlled.

The invention claimed is:

1. A gas boiler comprising:

a ventilator that introduces external air and supplies air necessary for combustion;

a gas valve that adjusts supply of a gas for combustion;

a burner that combusts a mixture of the gas for combustion and the air supplied by the ventilator;

a combustion chamber in which combustion by the burner occurs;

a heat exchanger that absorbs combustion heat of the combustion of the gas for combustion and generated by the burner;

an exhaust gas hood through which the combustion gas passing through the heat exchanger is discharged, wherein the gas for combustion passing through the gas valve is supplied to an inlet of the ventilator, and the inlet of the ventilator includes an output adjusting device comprises an air inlet through which the external air is supplied to the ventilator, an air adjustment valve that adjusts amount of the air supplied through the air inlet, a gas outlet through which the gas for combustion passing through the gas valve is discharged, and a gas adjustment valve that adjusts amount of the gas for combustion passing through the gas outlet; and a valve driving unit that drives the air adjustment valve and the gas adjustment valve, wherein the air adjustment valve and the gas adjustment valve are integral with each other, the air adjustment valve and the gas adjustment valve are coupled in concentric circular shapes to a valve movable shaft, the air inlet and the gas outlet have concentric cylindrical shapes that are opened and closed during reciprocations of the air adjustment valve and the gas adjustment valve, and output of the burner is continuously adjusted by adjusting distances between the air adjustment valve and the gas adjustment valve, and between the air inlet and the gas outlet.

2. The gas boiler of claim 1, wherein distance between the air adjustment valve and the air inlet, and the distance between the gas adjustment valve and the gas outlet, are changed equally.

3. The gas boiler of claim 1, wherein the air adjustment valve and the gas adjustment valve are integrally operated by the valve driving unit to continuously adjust amounts of the air and the gas for combustion which are supplied.

4. The gas boiler of claim 1, wherein the gas valve and the gas outlet are located on an axis of the valve movable shaft, and the air adjustment valve and the air inlet are located around outer surfaces of the gas valve and the gas outlet.

5. The gas boiler of claim 4, wherein a position where the gas valve contacts the gas outlet is lower in height than a position where the air adjustment valve contacts the air inlet, so that the gas for combustion discharged to the gas outlet is mixed with the air supplied in a mixing chamber, in the ventilator, without leaking to the air inlet.

6. A method of adjusting output of a gas boiler comprising:

setting an output value of a boiler in accordance with a thermal load of the boiler;

comparing the output value set with a limit output value of the boiler; and when the output value set is larger than or equal to the limit output value, changing the output of the boiler by changing air in a mixture of air and a gas for combustion supplied to the boiler in proportion to the output value set, and when the output value set is less than the limit output value, adjusting a ratio of the air and the gas for combustion in the mixture of the air and the gas for combustion, supplied to the boiler, in proportion to the output value set.

7. The method of adjusting output of a gas boiler of claim 6, wherein, when the output value set is less than the limit output value, adjusting the ratio of the air and the gas for combustion in the mixture of the air and the gas for combustion in the mixture while maintaining the amount of the air supplied.

* * * * *